United States Patent [19]

Bauer et al.

[11] Patent Number: 4,717,271

[45] Date of Patent: Jan. 5, 1988

[54] CHARACTER-CARRYING DISC FOR A PRINTING MACHINE

[75] Inventors: Eric Bauer, Neuchatel; Blaise Moulin, Corcelles, both of Switzerland

[73] Assignee: Caracteres S.A., Switzerland

[21] Appl. No.: 36,113

[22] Filed: Apr. 9, 1987

[30] Foreign Application Priority Data

Apr. 16, 1986 [CH] Switzerland ..... 1530/86

[51] Int. Cl.[4] ..... B41J 1/30

[52] U.S. Cl. ..... 400/175; 400/144.2

[58] Field of Search ..... 400/144, 144.1, 144.2, 400/175; 24/674, 676, 677; 464/77, 51; 403/155, 326

[56] References Cited

U.S. PATENT DOCUMENTS

| | | | |
|---|---|---|---|
| 1,349,569 | 8/1920 | Hart | 24/676 |
| 4,389,129 | 6/1983 | Sugiura | 400/175 |
| 4,408,909 | 10/1983 | Asano et al. | 400/175 |
| 4,521,124 | 6/1985 | Moulin | 400/175 |
| 4,576,494 | 3/1986 | Smith | 400/175 |
| 4,613,244 | 9/1986 | Okabayashi et al. | 400/175 |

*Primary Examiner*—Edgar S. Burr
*Assistant Examiner*—Joseph McCarthy
*Attorney, Agent, or Firm*—Silverman, Cass, Singer & Winburn, Ltd.

[57] ABSTRACT

A character-carrying disc comprises, arranged on its front face, a circular arc-shaped wire spring ended by two branches, which are rectilinear and bent inwardly constituting a small fork adapted to grip the shaft of a printing machine in which the disc is used and to engage an annular groove of this shaft. This disc carries a slidable pin on a shoulder of which the central portion of the arc-shaped part of the spring bears so as to maintain the pin in an axial position in which it co-operates with a member of the machine to provide a drive connection for rotation of the disc. Thus, the spring performs a double function, ensuring on the one hand the return of the pin to its working position and on the other hand the securing of the disc on the shaft of the machine.

4 Claims, 6 Drawing Figures

CHARACTER-CARRYING DISC FOR A PRINTING MACHINE

BACKGROUND OF THE INVENTION (a) Field of the Invention

The invention relates to a character-carrying disc for a printing machine.

(b) Description of the Prior Art

It is known for such a character-carrying disc to comprise a movable member mounted on the body of the disc so as to be able to occupy on the one hand a working position in which it is engaged with a driving member of the machine intended to drive this disc in rotation, and on the other hand a retracted position in which it is clear from this driving member of the machine. The disc further comprises an elastic return device acting on said movable member and urging the latter into its working position, and a spring which co-operates with the element of the machine which mounts the disc so as to maintain the disc in place in the machine.

In known discs of this general character, the movable member by which the disc is rotatably driven by the machine is generally constituted by a pin. This pin is slidably mounted in a bore in a hub of the disc and is returned to its working position by a coil spring engaged thereon.

The manufacture of such discs is relatively expensive, especially by reason of the operations associated with the mounting of the retractable pin and of its return spring, as well as the mounting of the separate spring, generally a wire spring, which in use secures the disc on a shaft providing the mounting element of the printing machine.

SUMMARY OF THE INVENTION

The object of the present invention is to simplify the manufacture of such discs, especially the assembly operations involved and, consequently, to reduce their cost.

This object is achieved by the fact that the disc according to the invention comprises a spring arranged in such a way as to function not only to secure the disc on the mounting element of the machine which in use carries the disc, but also to return said movable member of the disc to its working position.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilizing the same or equivalent principles may be used and structural changes may be made as desired by those skilled in the art without departing from the present invention and the purview of the appended claims.

DESCRIPTION OF THE PREFERRED EMBODIMENTS

Figure 1:
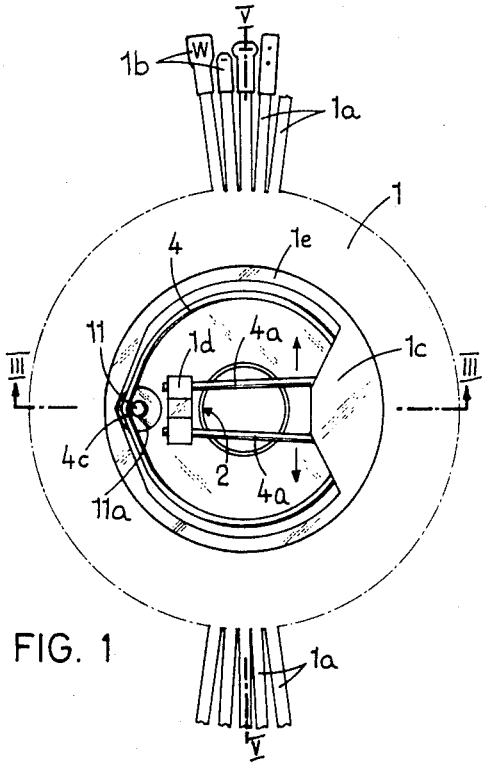
FIG. 1 is a plan view, from above, of a part of a character-carrying disc for a printing machine.
Figure 2:
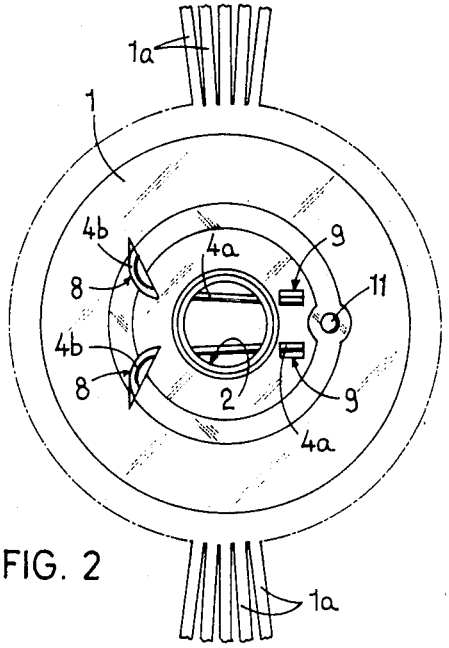
FIG. 2 is an underneath plan view, of a part of this disc.

The disc illustrated in the drawings, moulded from plastic material, is designated by reference 1. It is provided with resiliently deformable arms 1*a* carrying, at their radially outer ends, characters designated by 1*b*. This disc is provided with a central through bore 2 permitting engagement on an end journal 3*a* of a shaft of the machine which provides the mounting element which carries the disc 1 in use designated at 3 and which is shown in dot and dash lines in FIG. 5.

Figure 3:
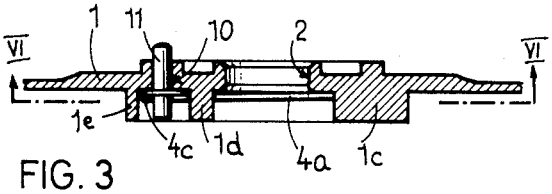
FIG. 3 is a sectional view of a part of this disc, on the line III—III of FIG. 1.

The disc 1 carries, arranged on its front face, a wire spring 4, having the shape of an open circle, the end portions of which are bent inwardly and form two rectilinear branches 4*a* constituting a fork, gripping the journal 3*a* of the shaft 3 and engaging with an annular groove 5 formed in the end journal 3*a*. The spring 4 is maintained in place by two boss-like protrusions with which the disc is moulded, designated the one by 1*c* and the other one by 1*d* (FIGS. 1 and 3). The protrusion 1*c* is provided with two recesses 6, opening laterally, in which are respectively engaged round portions 4*b* of the spring 4 providing merging connections between the main part of the spring 4, formed as an arc of circle, and the end portions 4*a*, while the protrusion 1*d* is provided with two recesses 7, also opening laterally, in which are respectively engaged the free ends of the end portions 4*a* of the spring 4. The disc 1 is formed with two holes 8 and two holes 9 due to the passage of core parts of the manufacturing mould which core parts serve for formation of the recesses 6 and 7, respectively.

Figure 4:
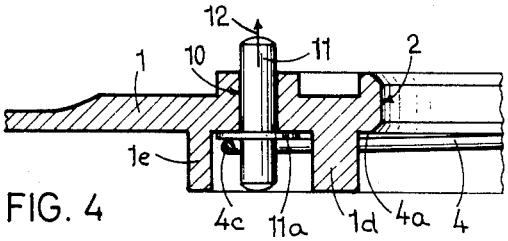
FIG. 4 shows a detail of FIG. 3 to a larger scale.

The disc is provided with a through bore 10 in which is engaged a pin 11 (FIG. 4), presenting an outer shoulder 11*a*, longitudinally movable in a direction parallel to the axis of the disc and which is intended to engage a recess provided in a driving member (not shown) of the printing machine, the disc being thus rotatably driven through the intermediary of the pin 11. The central zone, designated by 4*c*, of the circular arc-shaped portion of the spring 4 bears on the shoulder 11*a* of the pin 11 and urges the pin in the direction of the arrow 12 (FIG. 4), thus moving it into its working position in which it engages the driving member of the printing machine.

Owing to the fact that the pin 11 is retractable against the action of the return spring 4, the disc can be fitted into the machine in any angular position, the pin being thus pushed by the driving member of the machine and brought into its retracted position. Then, the driving member rotating while the disc 1 itself is prevented from rotating the pin 11 enters into the recess of the driving member at the moment this recess reaches a position aligned with the pin 11. The axial displacement of the pin on the one hand releases the disc and, on the other hand, renders it rigid with the driving member of the machine.

Figure 5:
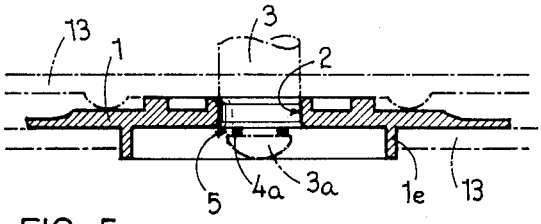
FIG. 5 is a sectional view of a part of the disc, on the line V—V of FIG. 1.
Figure 6:
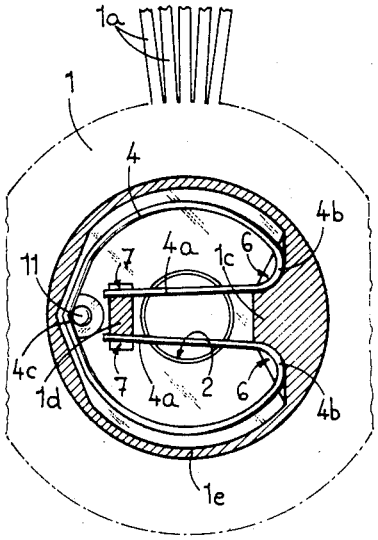
FIG. 6 is a sectional view of a part of this disc, on the line VI—VI of FIG. 3.

It is to be noted that the disc 1 will be positioned when in use, in a protective case indicated in dot and dash lines at 13 in FIG. 5, engaging in a space provided for this purpose in the printing machine. The disc 1 when fitted is centered in the case 13 by means of an annular collar 1*e* provided for this purpose on the rear face of the disc 1.

Owing to the fact that one and same spring ensures at the same time the return into working position of the retractable pin 11 and the securing of the disc 1 on the shaft 3 of the machine, the manufacture of the disc, especially the assembly operations, is greatly simplified. Thus, the manufacturing cost of the disc is correspondingly reduced.

As a modification, the movable driving member of the disc can be rigid with its return spring being, for instance, constituted by a pin made of plastic material moulded onto the spring.

Also as a further modification, the movable driving member of the disc could be made in one piece with its return spring being, for instance, constituted by a portion of the spring bent out from its plane.

Obviously, the shape and the arrangement of the return spring as well as its mode of securing to the body of the disc, especially the number and arrangement of the securing protrusions of this spring, could be different from that which has been described and illustrated.

We claim:

1. A character-carrying disc mountable on a printing machine having a driving member, said driving member having a hole therein and a shaft upon which said driving member is mounted, said shaft having at least one recess therein, said disc, comprising a disc body, a movable member mounted on said body and movable between a working position in which said movable member is engaged with said hole in said driving member, and a retracted position in which said movable member is withdrawn from said hole, a spring acting on said movable member for urging it into said working position, said spring having parallel leg portions spaced apart a distance less than the diameter of said shaft adapted to co-operate with said recess in said shaft so as to maintain the disc in place on said printing machine, said spring functioning both to secure the disc on said shaft which carries it and as an elastic return device to return said movable member of the disc to said working position.

2. A character-carrying disc as claimed in claim 1, in which said spring is a wire spring having the shape of an open circle, two ends of which are prolongated by terminal portions bent inwardly to form said leg portions, said leg portions constituting two branches of a fork adapted to grip said shaft and be positively engaged therewith, said spring acting at a central portion of its arc-shaped part on said movable member of the disc.

3. A character-carrying disc as claimed in claim 2, in which said movable member is constituted by a pin having a shoulder, said pin being slidably mounted on the disc and moving parallel to said shaft and in which said spring bears on said shoulder of said pin so as to act thereon and thus urge the pin to its working position.

4. A character-carrying disc as claimed in claim 2, including a protrusion on one side of said disc, said protrusion having two lateral recesses in which parts of the spring connecting the ends of its circular arc-shaped part to said two terminal portions respectively engage, a second protrusion on said one side of said disc, the ends of the said terminal portions being also engaged in lateral recesses of said second protrusion to maintain said spring on said disc.

* * * * *